US011170705B2

(12) United States Patent
Lee et al.

(10) Patent No.: US 11,170,705 B2
(45) Date of Patent: Nov. 9, 2021

(54) MINIMULIZED PIXEL CIRCUIT

(71) Applicant: SAPIEN SEMICONDUCTORS INC., Ulsan (KR)

(72) Inventors: Jae Hoon Lee, Busan (KR); Jin Woong Jang, Suwon-Si (KR)

(73) Assignee: SAPIEN SEMICONDUCTORS INC., Ulsan (KR)

( * ) Notice: Subject to any disclaimer, the term of this patent is extended or adjusted under 35 U.S.C. 154(b) by 0 days.

(21) Appl. No.: 17/155,435

(22) Filed: Jan. 22, 2021

(65) Prior Publication Data

US 2021/0233463 A1 Jul. 29, 2021

(30) Foreign Application Priority Data

Jan. 23, 2020 (KR) ..... 10-2020-0009383

(51) Int. Cl.
*G09G 3/32* (2016.01)

(52) U.S. Cl.
CPC ..... *G09G 3/32* (2013.01); *G09G 2300/0857* (2013.01); *G09G 2320/064* (2013.01)

(58) Field of Classification Search
CPC ..... G09G 3/32; G09G 2300/0857; G09G 2320/064; G09G 3/3648; G09G 3/3406; G09G 2300/0809; G09G 2310/06; G09G 2330/021; G09G 2300/0439
See application file for complete search history.

(56) References Cited

U.S. PATENT DOCUMENTS

2002/0084463 A1* 7/2002 Sanford ..... G09G 3/3233 257/82
2010/0045690 A1* 2/2010 Handschy ..... G09G 3/3629 345/549
2021/0201769 A1* 7/2021 Morris ..... G02B 27/0081

FOREIGN PATENT DOCUMENTS

JP 2014-056256 A 3/2014
KR 2008-0052406 A 6/2008
KR 2017-0111788 A 10/2017
KR 2019-0024937 A 3/2019

* cited by examiner

*Primary Examiner* — Muhammad N Edun
(74) *Attorney, Agent, or Firm* — Osha Bergman Watanabe & Burton LLP

(57) ABSTRACT

The present specification provides a pixel circuit miniaturized using a smaller number of transistors as compared with the related art. A 4T static random-access memory (SRAM) is used in an embedded pixel memory, and in order to prevent a voltage floating problem from occurring in a logic low state, a leakage current is designed to flow in one direction by adjusting a threshold voltage of a transistor. In addition, a pulse width modulation (PWM) control unit uses a smaller number of transistors as compared with the related art, and in order to prevent a voltage floating problem from occurring, a circuit capable of removing a floating voltage is provided.

6 Claims, 5 Drawing Sheets

MINIMULIZED PIXEL CIRCUIT

CROSS-REFERENCE TO RELATED APPLICATION

This application claims priority to and the benefit of Korean Patent Application No. 2020-0009383, filed on Jan. 23, 2020, the disclosure of which is incorporated herein by reference in its entirety.

BACKGROUND

1. Field of the Invention

The present invention relates to a pixel of a display, and more particularly, to a structure capable of reducing a size of a pixel circuit.

2. Discussion of Related Art

Active matrix liquid crystal displays maintain a state in which light is emitted while information of all other pixels is being updated. In the case of a digital method in which a memory is included inside a pixel, during one frame, data related to light to be output by a pixel is stored, and brightness is controlled through a pulse width modulation (PWM) method. In general, when three or four light-emitting elements (for example, light-emitting diodes (LEDs)) are included in one pixel, each light-emitting element is referred to as a subpixel.

FIG. 1 is a circuit diagram of a general subpixel.

Referring to FIG. 1, the subpixel may be divided into a light-emitting element LED, a pixel driving circuit unit that drives the light-emitting element, an embedded pixel memory unit that stores data related to driving of the light-emitting element, and a PWM control unit that processes a signal for controlling brightness of the light-emitting element. In the case of a pixel using a digital PWM driving method, image data is stored in an embedded pixel memory for a predetermined period of time (pixel programming). Gray clock signals for PWM control are input to the subpixel as in an example shown in FIG. 1. The number of gray clock signals MSB, MSB-1, MSB-2, . . . , and LSB is determined according to the number of bits of image data. The PWM control unit outputs the gray clock signal to the light-emitting element LED according to the image data stored in the embedded pixel memory. As a result, the light-emitting element LED emits light for an emission time (On duty) within one frame.

The size of the embedded pixel memory is determined according to the number of bits of image data, and a general embedded pixel memory includes a plurality of 6T static random-access memory (SRAM) cells.

FIG. 2 is a circuit diagram of a 6T SRAM.

Referring to FIG. 2, it can be confirmed that six transistors are used to store one bit. Therefore, when image data has 10 bits, the number of transistors used in an embedded pixel memory is 60.

FIG. 3 is a schematic circuit diagram of a PWM control unit.

Referring to FIG. 3, the PWM control unit includes a switching unit that switches a plurality of gray clock signals and an adder that adds signals output from the switching unit. In the case of the switching unit, three transistors are used, and when there are ten gray clock signals, a total of 30 transistors are required. In addition, since the adder includes ten NOR gates and one NAND gate, 24 transistors are required.

In summary, a total of 114 transistors are required to constitute an embedded pixel memory and a PWM control unit included in one subpixel operating with 10-bits image data. In addition, an additional transistor is also required for a pixel driving circuit.

Recently, in the case of a pixel implemented with a micro LED, a size of a pixel circuit needs to be reduced as a size of the LED is reduced. As a method of reducing the size of the pixel circuit, there is a method of reducing the number of used transistors. For example, a 4T SRAM is used for an embedded pixel memory instead of a 6T SRAM. However, when a 4T SRAM stores a logic low data (generally data "0"), a voltage floating problem may occur.

FIG. 4 is a reference diagram for describing a voltage floating problem of a 4T SRAM.

Referring to FIG. 4, a circuit diagram of the 4T SRAM can be confirmed. First, a process of storing a logic high data (data "1") will be described. In order to store data, a voltage is applied to a word line WL so that a transistor M1 is turned on. A logic high voltage corresponding to the data "1" is applied to a bit line BL. The logic high voltage is applied to a node Q, a transistor M3 is turned off, and a transistor M4 is turned on, thereby forming a logic low voltage in a node Q'. The transistor M2 is turned on by the logic low voltage of the node Q' so that the node Q may be maintained as logic high by Vdd.

On the other hand, a process of storing logic low data (data "0") will be described. Similarly, in order to store data, a voltage is applied to the word line WL so that the transistor M1 is turned on. A logic low voltage corresponding to the data "0" is applied to the bit line BL. The logic low voltage is applied to the node Q, the transistor M3 is turned on, and the transistor M4 is turned off, thereby forming a logic high voltage in the node Q'. The transistor M2 is turned off by the logic high voltage of the node Q'. Next, describing the node Q in a state in which the word line WL becomes logic low, since both the transistors M1 and M2 are turned off and are not connected to a ground, the node Q may be in a floating state. Therefore, it is difficult to expect that an embedded pixel memory stably maintains logic low data (data "0") during one frame.

There is a need for a method capable of stably storing data while reducing the number of transistors to reduce a size of a pixel circuit.

RELATED ART DOCUMENTS

Patent Documents

Korean Patent Application Publication No. 10-2017-0111788

SUMMARY OF THE INVENTION

The present invention is directed to providing a pixel circuit miniaturized using a smaller number of transistors as compared with the related art.

Objects of the present specification are not limited to the aforementioned objects and other objects not mentioned herein will be clearly understood from the following description by those skilled in the art.

According to an aspect of the present invention, there is provided a display apparatus including a display panel including a plurality of pixel circuits, a scan driving circuit configured to sequentially drive the pixel circuits arranged in a row direction in a plurality of scan lines connected to a word line of each pixel circuit, and a data driving circuit configured to output a signal related to driving of each of light-emitting elements to each embedded pixel memory through a plurality of data lines connected to a bit line of each pixel circuit.

According to another aspect of the present invention, there is provided a pixel circuit including a pixel driving circuit unit configured to drive a light-emitting element, an embedded pixel memory unit including a plurality of static random-access memory (SRAM) cells to store data related to the driving of the light-emitting element, and a pulse width modulation (PWM) control unit configured to process a signal for controlling brightness of the light-emitting element.

Each SRAM cell included in the embedded pixel memory unit may include a first N-type transistor having a drain terminal connected to a bit line for transmitting data, a gate terminal connected to a word line, and a source terminal connected to a first node, a second P-type transistor having a drain terminal connected to a high potential supply source, a gate terminal connected to a second node having a complementary relationship with the first node, and a source terminal connected to the first node, a third P-type transistor having a drain terminal connected to the high potential supply source, a gate terminal connected to the first node, and a source terminal connected to the second node, and a fourth N-type transistor having a drain terminal connected to the second node, a gate terminal connected to the first node, and a source terminal connected to a low power supply source. A magnitude of a threshold voltage of the first N-type transistor may be smaller than that of a threshold voltage of the second P-type transistor.

The PWM control unit may include a switching unit including a plurality of transistors to switch a plurality of gray clock signals and an adding unit configured to output signals output from the switching unit as one signal. Each transistor included in the switching unit may have a drain terminal connected to any one SRAM cell included in the embedded pixel memory unit, a gate terminal to which each gray clock signal is input, and a source terminal connected to the adding unit.

The adding unit included in the PWM control unit may include an inverter configured to invert the signal output from the switching unit and an anti-floating transistor having a drain terminal connected to an input terminal of the inverter, a gate terminal for receiving a control signal, and a source terminal connected to a low potential supply source.

The data driving circuit may output the signal related to the driving of the light-emitting element such that a time interval for outputting the signal related to the driving of the light-emitting element is longer than a time interval for the scan driving circuit to drive the pixel circuits arranged in the row direction.

A control signal input to the gate terminal of the anti-floating transistor may be received after a plurality of gray clock signals are input.

Other concrete matters of the present invention are included in the detailed description and drawings of the specification.

DETAILED DESCRIPTION OF EXEMPLARY EMBODIMENTS

Figure 1:
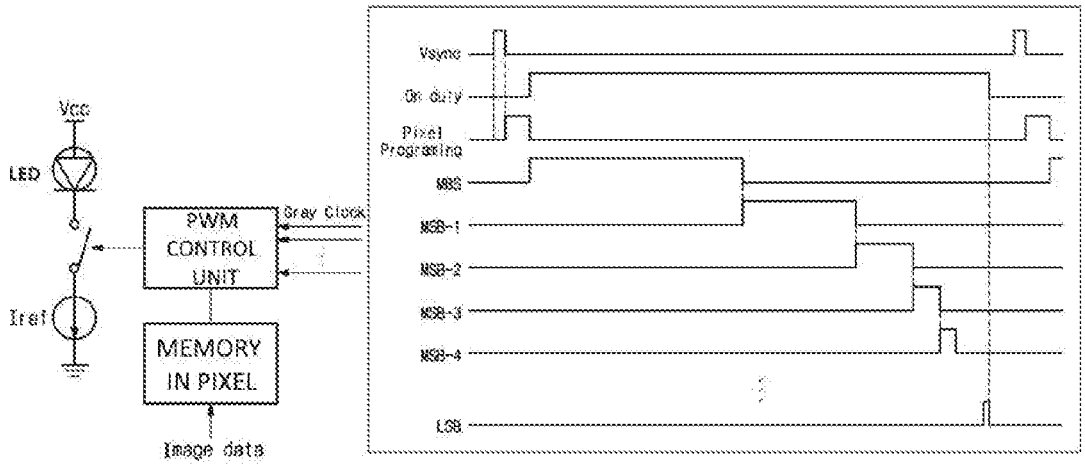
FIG. 1 is a circuit diagram of a general subpixel.
Figure 2:
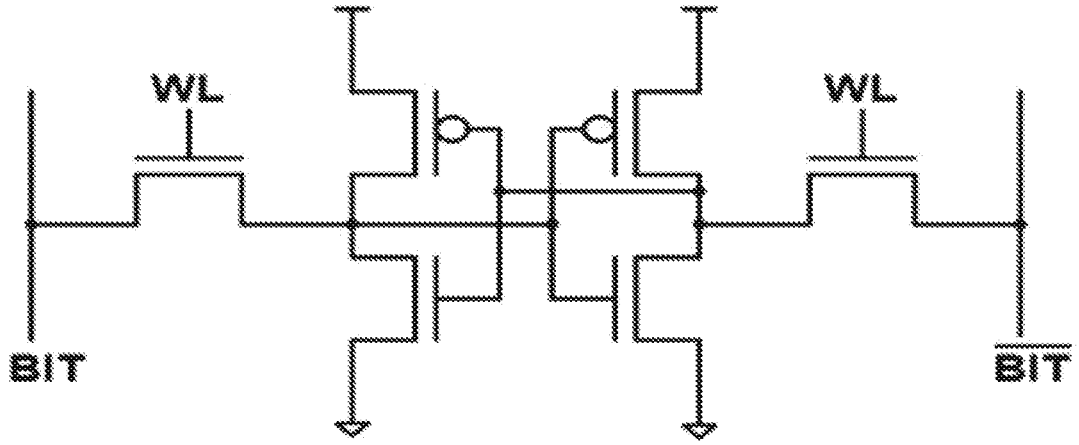
FIG. 2 is a circuit diagram of a 6T static random-access memory (SRAM).
Figure 3:
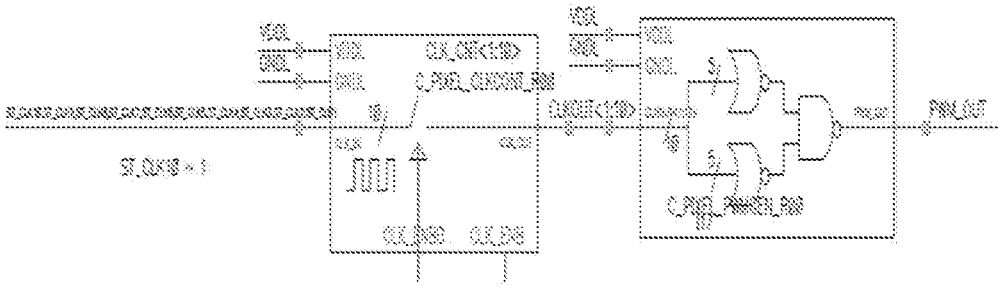
FIG. 3 is a schematic circuit diagram of a pulse width modulation (PWM) control unit.

Advantages and features of the invention disclosed in the present specification and methods for accomplishing the same will be more clearly understood from embodiments described below with reference to the accompanying drawings. However, the present specification is not limited to the following embodiments but may be implemented in various different forms. The embodiments are provided only to complete the disclosure of the present specification and to fully provide a person having ordinary skill in the art to which the present invention pertains (hereinafter, referred to as those skilled in the art) with the category of the present specification. The scope of the technical spirit of the present specification is only defined by the scope of accompanying claims.

The terms used in the present specification are for describing the embodiments and are not intended to limit the scope of the technical spirit of the present specification. As used herein, singular expressions, unless defined otherwise in context, include plural expressions. The meaning of "comprises" and/or "comprising" used in this specification does not exclude the existence or addition of one or more other components in addition to the mentioned components. The same reference numerals denote the same components throughout the specification. As used herein, the term "and/or" includes any and all combinations of one or more of the associated components. It will be understood that, although the terms "first," "second," and the like may be used herein to describe various components, these components should not be limited by these terms. These terms are only used to distinguish one component from another component. Therefore, a first component described below could be termed a second component without departing from the scope and spirit of the present invention.

Unless otherwise defined, all terms (including technical and scientific terms) used in the present specification may be used with the same meaning which may be commonly understood by the person with ordinary skill in the art to which the present invention belongs. In addition, it will be further understood that terms defined in commonly used dictionaries should not be interpreted in an idealized or excessive sense unless expressly and specifically defined.

In the following embodiments, the term "on" used in connection with an element state may refer to an activated state of an element, and the term "off" may refer to an inactive state of the element. The term "on" used in connection with a signal received by an element may refer to a signal for activating the element, and the term "off" may refer to a signal for deactivating the element. An element may be activated by a high voltage or a low voltage. For example, a P-type transistor is activated by a low voltage, and an N-type transistor is activated by a high voltage.

Therefore, it should be understood that "on" voltages for the P-type and N-type transistors have opposite (low vs high) voltage levels.

It will be understood that when an element is referred to as being "connected to," or "coupled to" another element, it can be directly connected to or coupled to another element or intervening elements may be present. In contrast, when an element is referred to as being "directly connected to" or "directly coupled to" another element, there are no intervening elements. Hereinafter, embodiments of the present invention will be described in detail with reference to the accompanying drawings.

Figure 5:
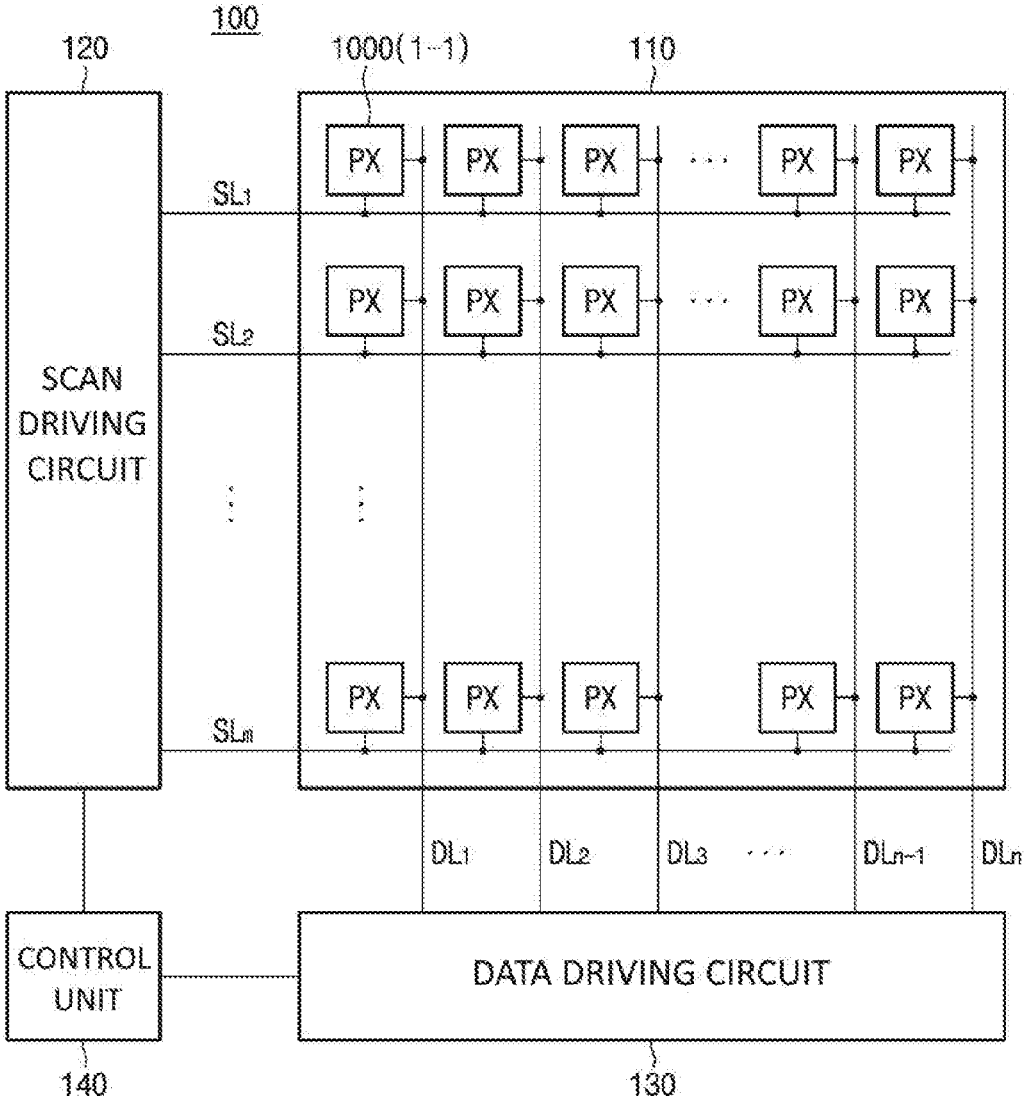
FIG. 5 illustrates a display apparatus including a plurality of pixel circuits according to the present specification.

FIG. 5 illustrates a display apparatus including a plurality of pixel circuits according to the present specification.

Referring to FIG. 5, a display apparatus 100 according to the present specification may include a display panel 110, a scan driving circuit 120, a data driving circuit 130, and a control unit 140.

The display panel 110 may include a plurality of pixels PX according to the present specification. The plurality of pixels PX may be provided as m×n pixels PX arranged in a matrix form (wherein m and n are natural numbers). However, the plurality of pixels may be arranged in various patterns having a zigzag form and the like according to embodiments.

The display panel 110 may be implemented as one of a liquid crystal display (LCD), a light-emitting diode (LED) display, an organic LED (OLED) display, an active-matrix OLED (AMOLED) display, an electrochromic display (ECD), a digital mirror device (DMD), an actuated mirror device (AMD), a grating light valve (GLV), a plasma display panel (PDP), an electro luminescent display (ELD), and a vacuum fluorescent display (VFD) and may be implemented as other types of flat panel displays or flexible display device. In the present specification, an example of an LED display panel be described.

Each pixel PX may include a plurality of light-emitting elements. The light-emitting element may be an LED. The LED may be a micro LED having a size of 80 μm or less. One pixel PX may output light with various colors through the plurality of light-emitting elements having different colors. For example, one pixel PX may include red, green, and blue light-emitting elements. For another example, when a white light-emitting element may be further included, the white light-emitting element may replace any one of the red, green, and blue light-emitting elements. Each light-emitting element included in one pixel PX is referred to as a "subpixel."

Each pixel PX may include a pixel circuit that drives a plurality of subpixels. The pixel circuit may drive a turn-on or turn-off operation of the subpixel in response to a control signal output from the scan driving circuit 120 and/or the data driving circuit 130. The pixel circuit may include at least one thin film transistor and at least one capacitor. The pixel circuit may be implemented as a stacked structure on a semiconductor wafer.

The display panel 110 may include scan lines $SL_1$ to $SL_m$ arranged in a row direction and data lines $DL_1$ to $DL_n$ arranged in a column direction. The pixels PX may be positioned at intersections between the scan lines $SL_1$ to $SL_m$ and the data lines $DL_1$ to $DL_n$. Each pixel PX may be connected to any one scan line $SL_k$ and any one data line $DL_k$. The scan lines $SL_1$ to $SL_m$ may be connected to the scan driving circuit 120, and the data lines $DL_1$ to $DL_n$ may be connected to the data driving circuit 130.

The scan driving circuit 120 may drive the pixels connected to any one of the scan lines $SL_1$ to $SL_m$. Preferably, the scan driving circuit 120 may sequentially select the scan lines $SL_1$ to $SL_m$. For example, the pixels connected to a first scan line SL1 may be driven during a first scan driving time, and the pixels connected to a second scan line $SL_2$ may be driven during a second scan driving time. The operation of the scan driving circuit 120 according to the present specification will be described in more detail below.

The data driving circuit 130 may output a signal related to a gradation to each pixel through the data lines $DL_1$ to $DL_n$. One data line may be connected to the plurality of pixels in a vertical direction, but the signal related to the gradation may be input only to the pixels connected to the scan line selected by the scan driving circuit 120. The operation of the data driving circuit 130 according to the present specification will be described in more detail below.

The control unit 140 may output a control signal to operate the scan driving circuit 120 and the data driving circuit 130. The control unit 140 may output a control signal, which corresponds to image data corresponding to one image frame, to each of the scan driving circuit 120 and the data driving circuit 130.

The pixel PX according to the present specification may include a pixel driving circuit unit that drives a light-emitting element, an embedded pixel memory unit that includes a plurality of static random-access memory (SRAM) cells to store data related to driving of the light-emitting element, and a pulse width modulation (PWM) control unit that processes a signal for controlling brightness of the light-emitting element. The basic roles of the pixel driving circuit unit, the embedded pixel memory unit, and the PWM control unit of a pixel circuit according to the present specification have been described with reference to FIG. 1, and thus repetitive descriptions thereof will be omitted. However, the pixel circuit according to the present specification will be described based on the differences from the related art.

The embedded pixel memory unit of the pixel circuit according to the present specification may include 4T SRAM cells.

Figure 4:
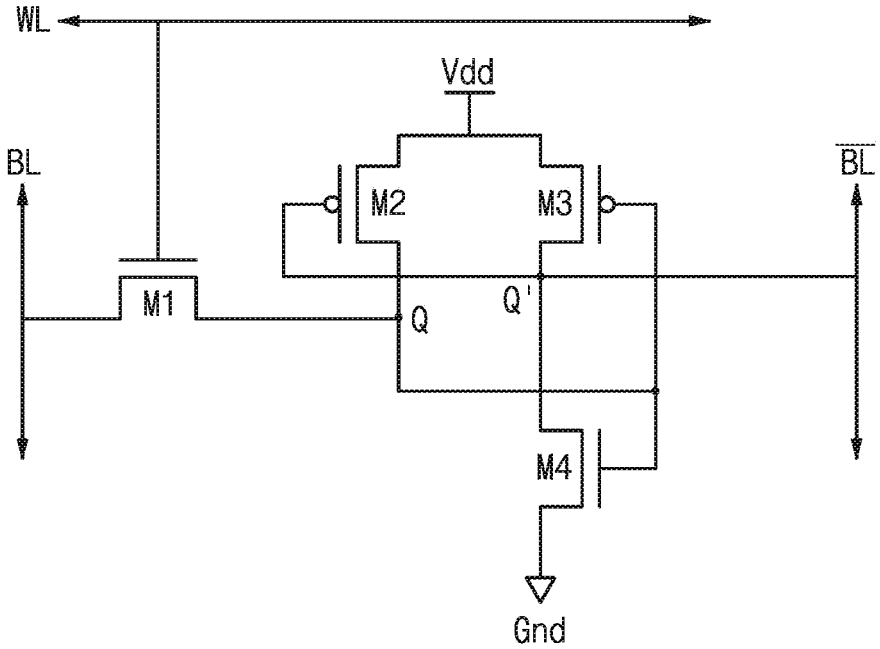
FIG. 4 is a reference diagram for describing a voltage floating problem of a 4T SRAM.

Referring to FIG. 4, transistors included in each 4T SRAM cell will be classified into first to fourth transistors M1 to M4.

The first transistor M1 may be an N-type transistor and may have a drain terminal connected to a bit line BL for transmitting data, a gate terminal connected to a word line WL, and a source terminal connected to a first node.

The second transistor M2 may be a P-type transistor and may have a drain terminal connected to a high potential supply source Vdd, a gate terminal connected to a second node Q' having a complementary relationship with a first node Q, and a source terminal connected to the first node Q.

The third transistor M3 may be a P-type transistor and may have a drain terminal connected to the high potential supply source Vdd, a gate terminal connected to the first node Q, and a source terminal connected to the second node Q'.

The fourth transistor M4 may be an N-type transistor and may have a drain terminal connected to the second node Q', a gate terminal connected to the first node Q, and a source terminal connected to a low power supply source GND.

In this case, a magnitude of a threshold voltage Vth of the first transistor M1 is smaller than that of a threshold voltage Vth of the second transistor M2.

As described above, when a conventional 4T SRAM stores logic low data (data "0"), a voltage floating problem may occur. A process of storing the logic low data (data "0") will be described again. In order to store data, a voltage is applied to the word line WL so that the transistor M1 is turned on. A logic low voltage corresponding to the data "0" is applied to the bit line BL. The logic low voltage is applied to the node Q, the transistor M3 is turned on, and the transistor M4 is turned off, thereby forming a logic high voltage in the second node Q'. The second transistor M2 is turned off by the logic high voltage of the second node Q'. Next, describing the first node Q in a state in which the word line WL becomes logic low, both the first transistor M1 and the second transistor M2 are in a state of being turned off. A leakage current flowing from the source terminal to the drain terminal of the first transistor M1 in a state of being turned off will be referred to as a first leakage current $I_{leakage1}$. A leakage current flowing from the source terminal to the drain terminal of the second transistor M2 in a state of being turned off will be referred to as a second leakage current $I_{leakage2}$. Unlike the related art, since the magnitude of the threshold voltage Vth of the first transistor M1 is smaller than that of the threshold voltage Vth of the second transistor M2, a magnitude of the first leakage current $I_{leakage1}$ is greater than that of the second leakage current $I_{leakage2}$. Accordingly, even after the word line WL becomes logic low, a structure in which a potential is lowered in the order of the second transistor M2, the first node Q, and the first transistor M1 may be formed. The first node Q may be maintained as logic low using such a potential difference.

There are various methods of making the magnitude of the threshold voltage Vth diverse. There are various factors, which affect a threshold voltage, such as an amount of oxide trap charge (QoX), a Cox/oxide thickness, a body effect, a doping value of each layer, a base material of a gate and a substrate, and a charge amount of a gate depletion layer. A magnitude of a threshold voltage of a transistor may be diversely formed through the above factors. In particular, it is possible to adjust the magnitude of the threshold voltage to EH Vth, H Vth, L Vth, and EL Vth according to a process of the transistor. Preferably, the magnitude of the threshold voltage Vth of the first transistor M1 may be EL Vth, and the magnitude of the threshold voltage Vth of the second transistor M2 may be EH Vth.

When a 10-bit embedded pixel memory unit is formed, a total of 60 transistors is used because a 6T SRAM cell is used conventionally, but only a total of 40 transistors may be used because the 4T SRAM cell is used. Thus, not only can the size of the pixel circuit be reduced, but also the conventional voltage plotting problem can be solved.

In addition, the size of the PWM control unit can be implemented using a smaller number of transistors than that in the related art.

Figure 6:
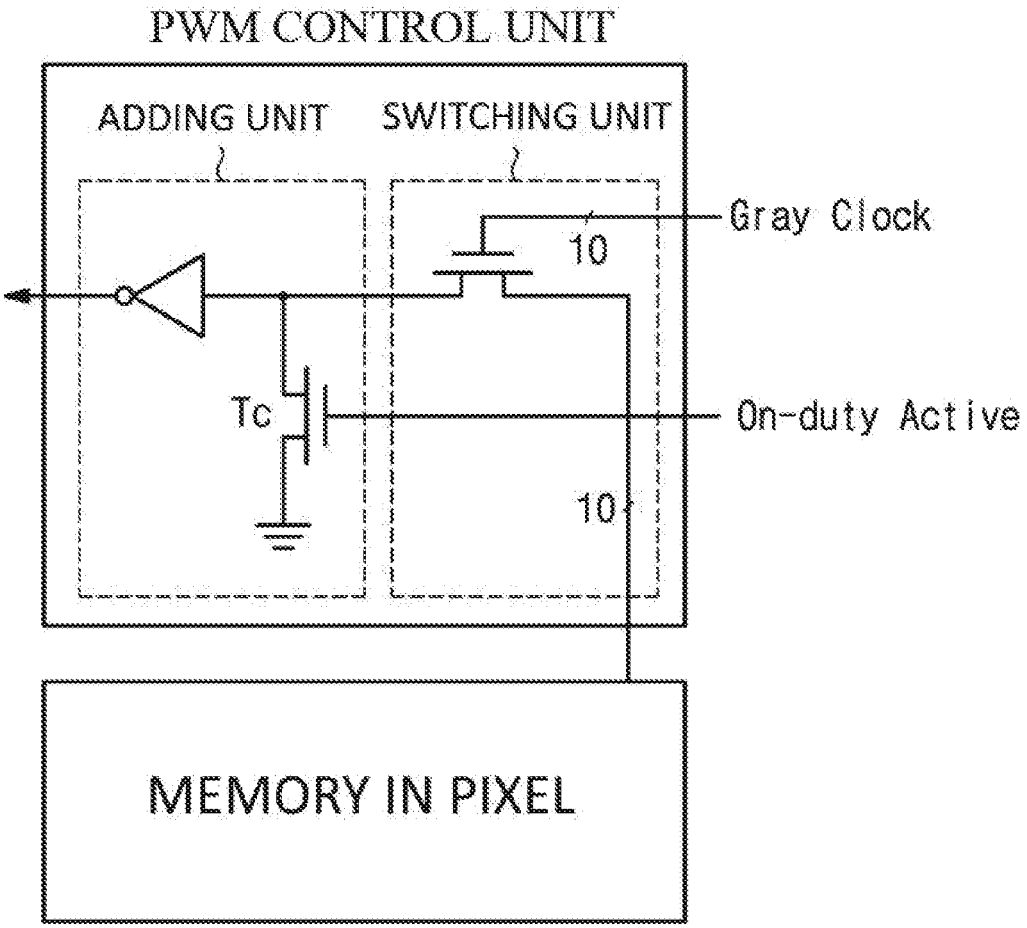
FIG. 6 is an exemplary circuit diagram of a control unit according to the present specification.

FIG. 6 is an exemplary circuit diagram of the PWM control unit according to the present specification.

Referring to FIG. 6, the PWM control unit according to the present specification may include a switching unit and an adding unit. The switching unit may include a plurality of transistors to switch a plurality of gray clock signals. The adding unit may output signals output from the switching unit as one signal.

Each transistor included in the switching unit may have a drain terminal connected to any one SRAM cell included in the embedded pixel memory unit, a gate terminal to which each gray clock signal is input, and a source terminal connected to the adding unit. FIG. 6 illustrates an embodiment in which image data has 10 bits, and the switching unit is illustrated as receiving ten gray clock signals and including ten transistors.

According to one embodiment of the present specification, the adding unit may include an inverter that inverts a signal output from the switching unit and an anti-floating transistor Tc that has a drain terminal connected to an input terminal of the inverter, a gate terminal for receiving a control signal, and a source terminal connected to the low potential supply source.

When a 10-bit PWM control unit is formed, in the related art, a total of 54 transistors are used, but in the PWM control unit according to the present specification, only a total of 40 transistors may be used because the 4T SRAM cell is used. Thus, not only can the size of the pixel circuit be reduced, but also the conventional voltage plotting problem can be solved.

Hereinafter, a timing of a signal for operating a pixel circuit according to the present specification will be described.

Figure 7:
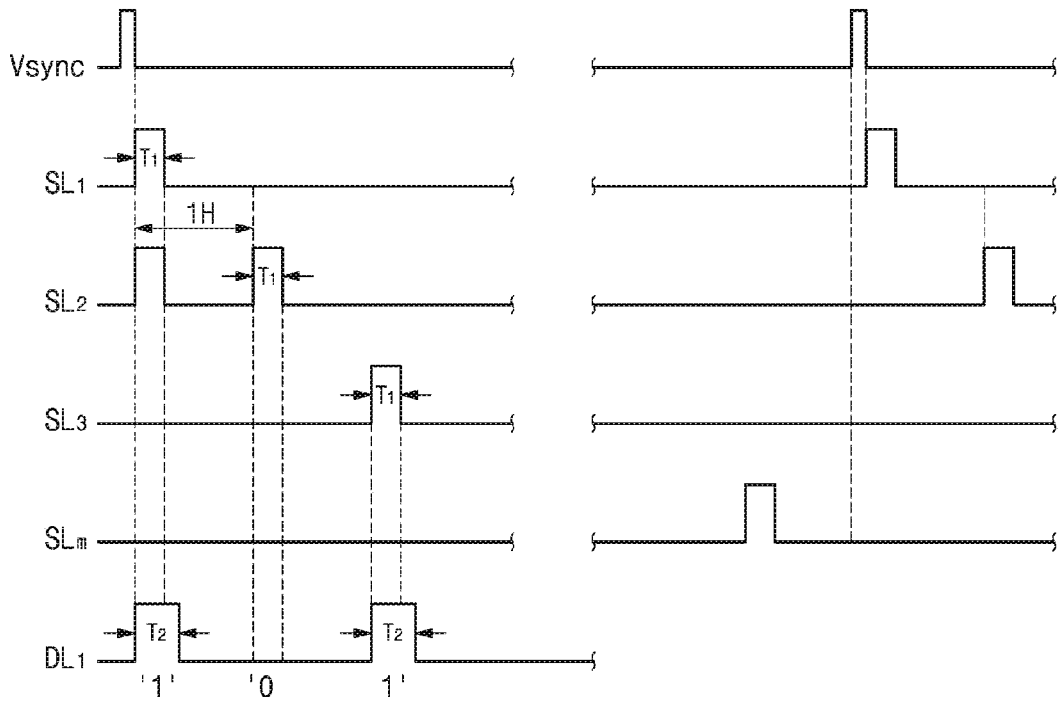
FIG. 7 is a reference diagram of signal timings of scan lines and data lines.

FIG. 7 is a reference diagram of signal timings of scan lines and data lines.

Referring to FIG. 7, "Vsync" denotes a timing of dividing one frame and one frame of a screen. During one frame, the scan driving circuit 120 may sequentially drive the pixels arranged in the row direction through the scan lines $SL_1$ to $SL_m$. For example, the pixels connected to the first scan line SL1 may be driven during the first scan driving time, and the pixels connected to the second scan line SL2 may be driven during the second scan driving time. A signal interval between the scan lines will be denoted as "1H." Since a logic high voltage is applied to the word line WL during a time interval $T_1$ for the scan driving circuit 120 to drive pixel circuits arranged in the row direction, data may be stored in the embedded pixel memory unit.

The data driving circuit 130 may output a signal related to a gradation to each pixel through the data lines $DL_1$ to $DL_n$. FIG. 7 illustrates an example of a signal output from a first data line $DL_1$. In this case, the data driving circuit 130 may output the signal related to driving of the light-emitting element such that a time interval $T_2$ for outputting the signal related to driving of the light-emitting element is longer than the time interval $T_1$ for the scan driving circuit 120 to drive the pixel circuits arranged in the row direction. Through such timing control of a signal, a voltage of the first node Q of the 4T SRAM cell can be prevented from floating. Meanwhile, the data driving circuit 130 may set the time interval $T_2$ for outputting the signal related to the driving of the light-emitting element so as to be less than or equal to half of the signal interval 1H between the scan lines.

Meanwhile, the anti-floating transistor Tc also serves to prevent the occurrence of a floating voltage at an input terminal of the adding unit.

Figure 8:
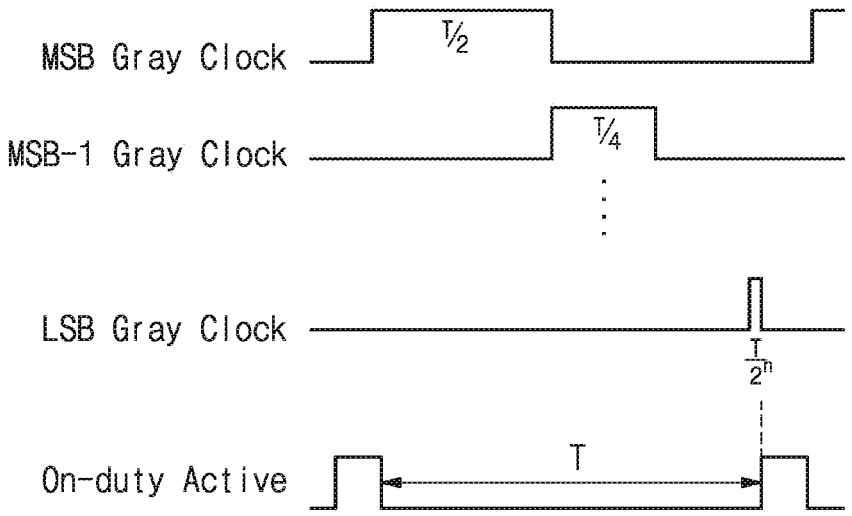
FIG. 8 is a reference diagram of timings of signals input to an anti-floating transistor.

FIG. 8 is a reference diagram of timings of signals input to the anti-floating transistor.

Referring to FIG. 8, a plurality of gray clock signals (MSB Gray Clock, MSB-1 Gray Clock, . . . , and LSB Gray Clock) input to the PWM control unit can be confirmed. A control signal (On-duty Active) input to the gate terminal of the anti-floating transistor Tc may be received after the plurality of gray clock signals are input.

Referring again to FIG. 6, the input terminal of the inverter will be described. The input terminal of the inverter is a node to which the plurality of gray clock signals are output from the switching unit. When a signal corresponding to a last bit ends in a logic high state among the plurality of gray clock signals, the input terminal of the inverter may float in a logic high state. In FIG. 8, the signal corresponding to the last bit is illustrated as LSB Gray Clock but may be MSB Gray Clock. Accordingly, after all of the plurality of gray clock signals are input, that is, after the last gray clock signal is input, a control signal is input to the gate terminal of the anti-floating transistor Tc. When the anti-floating transistor Tc is turned on by the control signal, a logic high voltage of the input terminal of the inverter may be discharged toward the low potential supply source through the anti-floating transistor Tc. Thus, it is possible to prevent a floating state of the input terminal of the inverter.

The control signal may be output from the scan driving circuit 120, the data driving circuit 130, or the control unit 140. In addition, although the control signal is not described in detail herein, the control signal may be output from a separate component that outputs the plurality of gray clock signals.

Meanwhile, in order to execute the control logic of the scan driving circuit 120, the data driving circuit 130, or the control unit 140 described in the present specification, the scan driving circuit 120, the data driving circuit 130, or the control unit 140 may include a processor, an application-specific integrated circuit (ASIC), other chipsets, a logic circuit, a register, a communication modem, a data processing device, and the like known in the technical field to which the present invention pertains. In addition, when the above-described control logic is implemented in software, the control logic of the scan driving circuit 120, the data driving circuit 130, or the control unit 140 may be implemented in a set of computer program modules. In this case, the program module may be stored in a memory device and executed by a processor.

The computer program may include a code encoded in a computer language such as C/C++, C#, JAVA, Python, a machine language, or the like that may be read by a processor (CPU) of a computer through a device interface of the computer in order to cause the computer to read the program and execute the methods implemented in the program. This code may include functional codes related to functions or the like that define the necessary functions for executing the methods and include control codes related to the execution procedures necessary to cause the processor of the computer to execute the functions in a predetermined procedure. In addition, the code may further include a memory reference related code for additional information or media necessary to cause the processor of the computer to perform the functions as to which location (address) of the computer's internal or external memory should be referenced. Furthermore, when the processor of the computer needs to communicate with any other computers or servers remotely to perform the functions, the code may further include a communication related code as to whether how to communicate with any other computers or servers remotely using the communication module of the computer or which information or media should be transmitted or received during communication.

The stored medium is not a medium for storing data for a short time, such as a register, a cache, or a memory and refers to a medium which semi-permanently stores data and is capable of being read by a device. Examples of the stored medium include read-only memories (ROMs), random-access memories (RAMS), compact disc ROMs (CD-ROMs), magnetic tapes, floppy disks, and optical data storage devices, but the present invention is not limited thereto. That is, the program may be stored in various recording media used for various servers accessible by the computer, or on various recording media used for the user's computer. In addition, the medium may be distributed over a network-connected computer system, and a computer-readable code may be stored in a distributed manner.

According to an aspect of the present specification, the size of a pixel circuit can be reduced as compared with the related art. Accordingly, it is possible to provide a pixel circuit having a size suitable for a display using a micro LED.

According to another aspect of the present specification, the size of a pixel circuit is reduced as compared with the related art, thereby reducing an amount of power consumed by a display panel.

Effects of the present invention are not limited to the above-described effects, and other effects not described above may be clearly understood to those skilled in the art from the description.

Although the embodiments of the present invention have been described with reference to the accompanying drawings, it should be understood that those skilled in the art can carry out other modifications without changing the technical spirit or essential features of the present invention. Therefore, it should be understood that the embodiments described herein are illustrative and not restrictive in all aspects.

What is claimed is:

1. A pixel circuit comprising:

a pixel driving circuit unit configured to drive a light-emitting element;

an embedded pixel memory unit including a plurality of static random-access memory (SRAM) cells to store data related to the driving of the light-emitting element; and a pulse width modulation (PWM) control unit configured to process a signal for controlling brightness of the light-emitting element, wherein each SRAM cell included in the embedded pixel memory unit includes a first N-type transistor having a drain terminal connected to a bit line for transmitting data, a gate terminal connected to a word line, and a source terminal connected to a first node, a second P-type transistor having a drain terminal connected to a high potential supply source, a gate terminal connected to a second node having a complementary relationship with the first node, and a source terminal connected to the first node, a third P-type transistor having a drain terminal connected to the high potential supply source, a gate terminal connected to the first node, and a source terminal connected to the second node, and a fourth N-type transistor having a drain terminal connected to the second node, a gate terminal connected to the first node, and a source terminal connected to a low power supply source, and a threshold voltage of the first N-type transistor is smaller than that of a threshold voltage of the second P-type transistor.

2. The pixel circuit of claim 1, wherein the PWM control unit includes a switching unit including a plurality of transistors to switch a plurality of gray clock signals, and an adding unit configured to output signals output from the switching unit as one signal, and each transistor included in the switching unit has a drain terminal connected to any one SRAM cell included in the embedded pixel memory unit, a gate terminal to which each gray clock signal is input, and a source terminal connected to the adding unit.

3. The pixel circuit of claim 2, wherein the adding nit includes:

an inverter configured to invert the signal output from the switching unit; and an anti-floating transistor having a drain terminal connected to an input terminal of the inverter, a gate terminal for receiving a control signal, and a source terminal connected to a low potential supply source.

4. A display apparatus comprising:

a display panel including a plurality of pixel circuits of any one of claims 1 to 3;

a scan driving circuit configured to sequentially drive the pixel circuits arranged in a row direction in a plurality of scan lines connected to a word line of each pixel circuit; and a data driving circuit configured to output a signal related to driving of each of light-emitting elements to each embedded pixel memory through a plurality of data lines connected to a bit line of each pixel circuit.

5. The display apparatus of claim 4, wherein the data driving circuit outputs the signal related to the driving of the light-emitting element such that a time interval for outputting the signal related to the driving of the light-emitting element is longer than a time interval for the scan driving circuit to drive the pixel circuits arranged in the row direction.

6. The display apparatus of claim 4, wherein a control signal input to the gate terminal of the anti-floating transistor is received after a plurality of gray clock signals are input.

* * * * *